US007152533B2

(12) United States Patent
Eches et al.

(10) Patent No.: US 7,152,533 B2
(45) Date of Patent: Dec. 26, 2006

(54) SABOT FOR SUB-CALIBRE PROJECTILES

(75) Inventors: Nicolas Eches, Plaimpied Givaudins (FR); Jean-Paul Fauchon, La Chapelle Saint Ursin (FR)

(73) Assignee: GIAT Industries, Versailles (FR)

( * ) Notice: Subject to any disclaimer, the term of this patent is extended or adjusted under 35 U.S.C. 154(b) by 333 days.

(21) Appl. No.: 10/773,152

(22) Filed: Feb. 9, 2004

(65) Prior Publication Data

US 2004/0244631 A1 Dec. 9, 2004

(30) Foreign Application Priority Data

Feb. 10, 2003 (FR) ..... 03 01578

(51) Int. Cl.
*F42B 14/06* (2006.01)

(52) U.S. Cl. ..... 102/521

(58) Field of Classification Search ..... 102/520, 102/521, 522, 523, 703
See application file for complete search history.

(56) References Cited

U.S. PATENT DOCUMENTS

| | | | | |
|---|---|---|---|---|
| 3,262,391 | A * | 7/1966 | Shober | 102/521 |
| 3,951,071 | A | 4/1976 | Germershausen | 102/93 |
| 4,351,094 | A | 9/1982 | Haberli | 29/1.2 |
| 4,517,899 | A * | 5/1985 | Haberli | 102/521 |
| 4,702,172 | A * | 10/1987 | Wallow et al. | 102/521 |
| 4,867,067 | A * | 9/1989 | Becker et al. | 102/521 |
| 5,103,735 | A * | 4/1992 | Kaste et al. | 102/521 |
| 5,227,580 | A * | 7/1993 | Berville et al. | 102/521 |
| 5,289,777 | A | 3/1994 | Sippel et al. | 102/521 |
| H1412 | H | 2/1995 | Kline et al. | 102/521 |
| 5,789,699 | A * | 8/1998 | Stewart et al. | 102/521 |
| 5,902,955 | A * | 5/1999 | Rossmann | 102/521 |
| 6,324,986 | B1 * | 12/2001 | Rossmann et al. | 102/521 |

FOREIGN PATENT DOCUMENTS

DE 40 34 062 A1 4/1992

* cited by examiner

*Primary Examiner*—Michael J. Carone
*Assistant Examiner*—James S. Bergin
(74) *Attorney, Agent, or Firm*—Steptoe & Johnson LLP

(57) ABSTRACT

A sabot for a projectile comprising at least two segments intended to surround and drive a sub-caliber penetrator, such sabot comprising a calibered thrust plate, wherein said sabot incorporates a body made of a light material, said body having at least one longitudinal insert made of a material having high mechanical properties, said insert having indentations cooperating with an external profile of said penetrator to allow it to be driven, said indentations extending those of said sabot body and which thus also cooperate with the external profile of said penetrator.

12 Claims, 7 Drawing Sheets

SABOT FOR SUB-CALIBRE PROJECTILES

FIELD OF INVENTION

1) Field of Invention

The technical scope of the invention is that of sabots for sub-calibre projectiles.

2) Description of the Related Art

In a known manner, sub-calibre projectiles comprise a sub-calibre penetrator held by a calibred sabot. The sabot is formed of several segments (at least two and generally three) and releases the penetrator upon exiting the weapon. The sabot generally has a sealing band that is positioned in a groove arranged on one part of the calibred sabot, a part usually called the thrust plate since is it here that the pressure of the propellant gases is exerted.

The sabot allows the velocity of the sub-calibre penetrator to be increased. However, it constitutes a dead weight that consumes part of the available kinetic energy and it is thus desirable to reduce the mass of the sabot in order to improve the velocity, and consequently, the performances of the penetrator.

Furthermore, present day sub-calibre munitions have longer and longer penetrators so as to improve the piercing performances upon impact on a target.

Such penetrators have substantial longitudinal and transversal inertias and must be firmly held in place during firing by the front and rear parts of the sabot.

However, reinforcing these parts, for example by ribbing, makes the sabot heavier and thus causes the penetrator to lose velocity.

By way of example, patents U.S. Pat. No. 5,103,735 and U.S. Pat. No. 5,359,938 describe a sabot having ribbing that improves its transversal rigidity.

To make the sabot lighter, it is also proposed to use a composite material in its manufacture. Patent GB2251676 describes, for example, a sabot whose segments are constituted by laminated elements made of oriented fiber composite materials.

This solution is, however, costly to implement.

The aim of this invention is to propose a sabot that overcomes such drawbacks.

Thus, the sabot according to the invention has been made lighter whilst providing mechanical performances adapted to the firing constraints of a highly elongated penetrator (L/D>30).

This sabot is, in addition, easy to manufacture and relatively inexpensive with respect to a sabot made entirely of composite material, for example.

SUMMARY OF THE INVENTION

Thus, the invention relates to a sabot for a projectile comprising at least two segments intended to surround and drive a sub-calibre penetrator, such sabot comprising a calibred thrust plate and wherein it incorporates a body made of a light material, such body having at least one longitudinal insert made of a material having high mechanical properties, such insert having indentations cooperating with an external profile of the penetrator to allow it to be driven, such indentations extending those of the body of the sabot and which thus also cooperate with the external profile of the penetrator.

The material of the insert or inserts will preferably have a longitudinal modulus of elasticity that is greater than or equal to 100 Giga Pascals and an elastic limit greater than of equal to 900 Mega Pascals.

The material of the insert or inserts may thus be selected from among the following materials: titanium or titanium alloy, steel, composite material.

According to one characteristic of the invention, the insert will be thinner at the thrust plate than on either side of it.

Each insert may extend on either side of the thrust plate, the body comprising at least two bearing surfaces level with the thrust plate for the insert, such surfaces arranged on either side of the thrust plate.

According to a first embodiment, the body of each segment may incorporate a longitudinal recess made in its plane of symmetry and intended to receive an insert.

The recess may pass radially through the body of the segment on either side of the thrust plate.

The insert may be made integral with the segment body by at least two screws arranged near to the front and rear ends of the insert.

According to a second embodiment, the body of each segment may incorporate at least two longitudinal recesses each made at a joint face intended to come into contact with another segment when the sabot is assembled, the inserts being thus positioned at the inter-segment joint faces of the sabot.

Each recess may thus incorporate a profile that cooperates with a matching profile carried by the insert.

According to one variant, each joint face may have two recesses: one placed to the fore of the thrust plate and the other to its rear, each recess being intended to receive a specific insert.

Alternatively, the recesses arranged in the body of each segment may extend on either side of the thrust plate, the body comprising at least two bearing surfaces for the insert at the thrust plate, such surfaces being arranged on either side of the thrust plate.

Each insert may be made integral with a segment body by at least one screw arranged at the thrust plate part of the segment in question.

BRIEF DESCRIPTION OF THE DRAWINGS

The invention will become more apparent from the following description of the different embodiments, such description being made with reference to the appended drawings, in which.

DETAILED DESCRIPTION OF PREFERRED EMBODIMENTS

Figure 1:
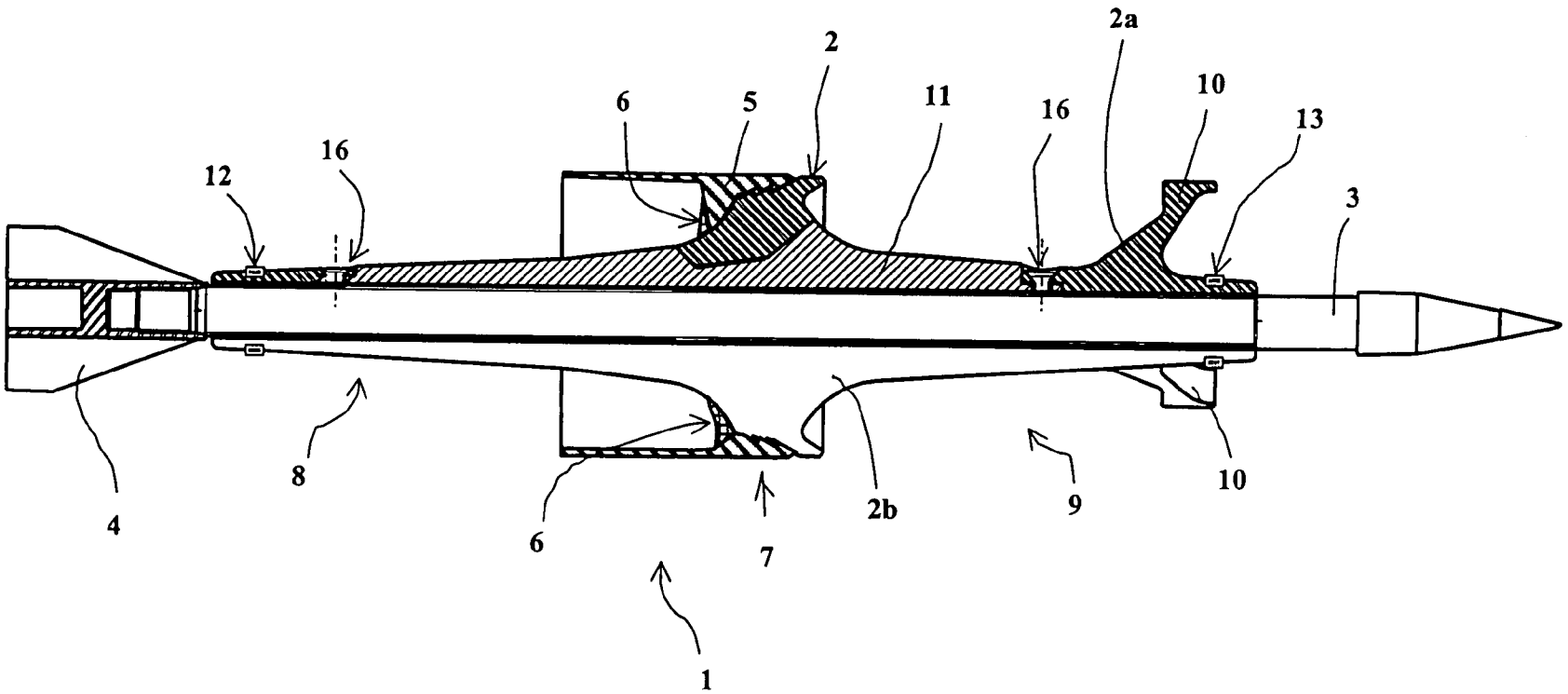
FIG. 1 shows a longitudinal section view of a sub-calibre projectile equipped with a sabot according to a first embodiment of the invention.

With reference to FIG. 1, a sub-calibre projectile 1 (or discarding-sabot projectile) comprises a sabot 2 surrounding a penetrator 3 fitted with a tailpiece 4. This projectile 1 is intended to be fastened to a combustible case, not shown.

The sabot classically comprises three segments 2*a*, 2*b*, 2*c* that are made integral with one another by a band 5, which also ensures the sealing against the propellant gases within the gun barrel (not shown), and by two retaining rings 12 and 13, one at the front and the other at the rear of the sabot (such rings being optional).

The segments are in contact with one another at their joint faces. The penetrator has threading (or grooves) that cooperate with matching threading (or grooves) on the sabot. Such an arrangement ensures that the penetrator is driven in translation by the sabot.

A silicon seal 6 is placed between the band 5 and the rear part of the sabot 2.

Classically, the sabot 2 incorporates a calibred thrust plate 7 arranged substantially level with the penetrator's 3 center of gravity. The sabot is prolonged on either side of the thrust plate 7 by a rear part 8 and a front part 9. The diameter of the front 9 and rear 8 parts decreases regularly between the thrust plate 7 and the front or rear end of the sabot 2.

The front part 9 of the sabot has calibred arms 10 evenly spaced angularly. There is one arm per segment, therefore here there are three arms for the sabot.

These arms form a seat ensuring the guidance of the front part of the sabot inside the gun barrel.

In accordance with the invention, the sabot comprises a body made of a light material, for example an aluminum alloy, such body incorporating at least one longitudinal insert 11 made of a material having high mechanical properties.

By light material, we mean a material having a density of less than 3. The segment body will preferably be made of an aluminum alloy, or perhaps a composite material.

By material having high mechanical properties, we mean a material having a longitudinal modulus of elasticity greater than or equal to 100 Giga Pascals and an upper elastic limit greater than or equal to 900 Mega Pascals.

These mechanical performances are well over those of aluminum. The following may, for example, be selected as the material for the inserts: titanium or a titanium alloy, high performance steel (for example, maraging steel) or a composite material (for example, a material based on oriented carbon fibers).

Figure 2A:
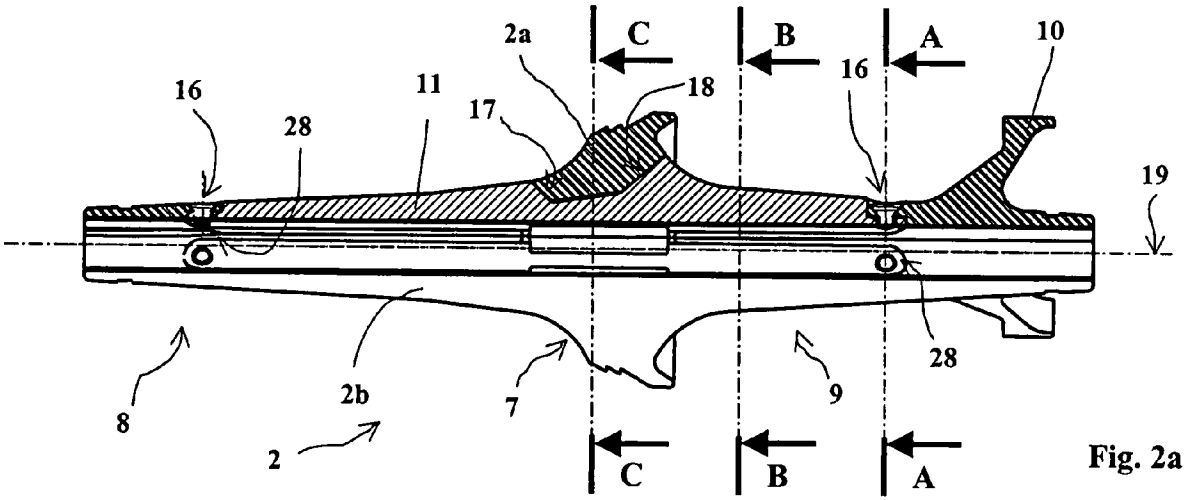
FIGS. 2*a* and 2*b* are two views of the same sabot according to the first embodiment, views in which the penetrator has been removed, view 2*a* being a section view and view 2*b* being a non-sectioned view.
Figure 2B:
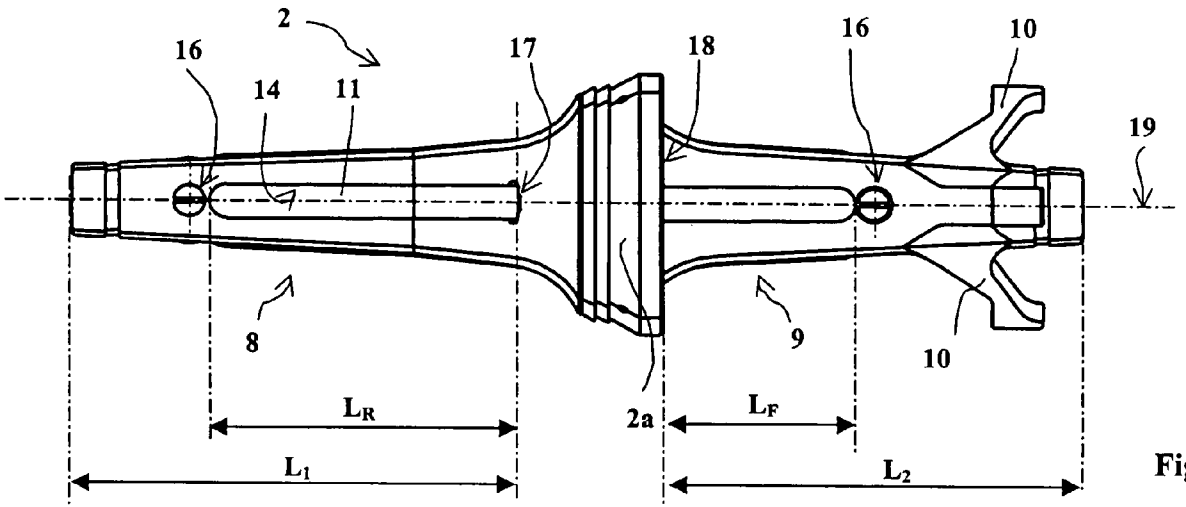

FIGS. 2*a*, 2*b* show the sabot 2 without the penetrator 3, the band 5 and rings 12 and 13.

Figure 3A:
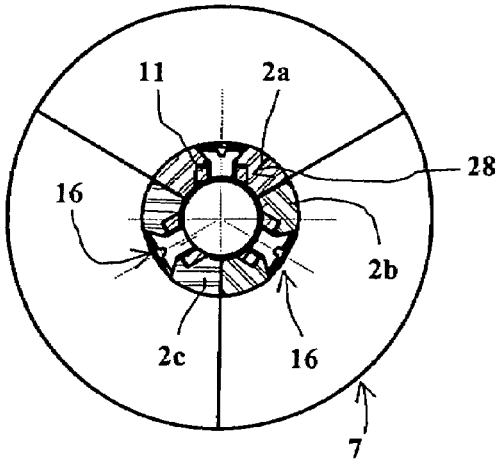
FIGS. 3*a* and 3*b* are cross sections of this sabot, such sections being made along the planes references respectively AA, BB and CC in FIG. 2*a*, FIGS. 4*a* and 4*b* are two views of a sabot according to a second embodiment, views in which the penetrator has been removed, view 4*a* being a longitudinal section and view 4*b* being a non-sectioned view.
Figure 3B:
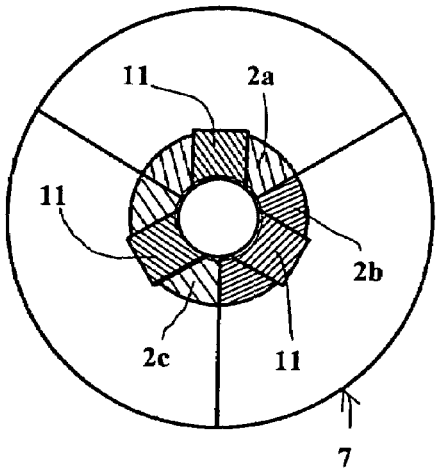
Figure 3C:
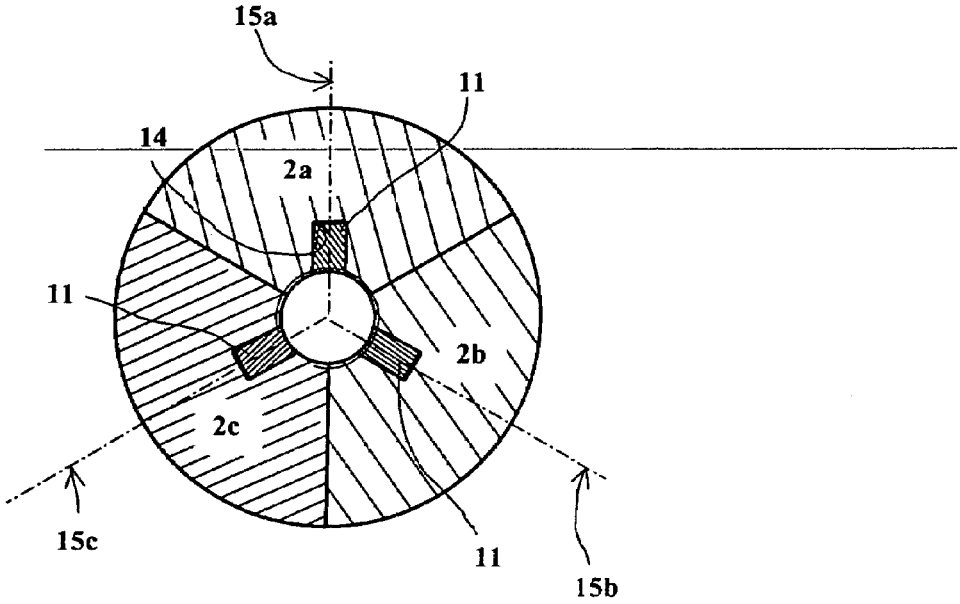

In accordance with this first embodiment of the invention, each segment 2*a*, 2*b* or 2*c* of the sabot incorporates a longitudinal recess 14 made in its plane of symmetry 15*a*, 15*b* or 15*c* and which is intended to receive an insert 11 (see more specifically FIGS. 3*a*, 3*b* and 3*c*).

The recess 14 passes through the segment body on either side of the thrust plate 7 (see FIGS. 2*a*, 2*b* and section 3*b*). Such an arrangement facilitates the machining of the recess 14 of the sabot.

Each insert 11 is in contact with the penetrator 3 and incorporates indentations (not shown, for example, threading or circular grooves) that cooperate with an external profile of the penetrator 3 to allow it to be driven.

The body 2 of the sabot also has analogous indentations (not shown) that prolong those in the inserts 11 and which cooperate with the external profile of the penetrator.

In practical terms, each insert 11 will be made integral with its sabot segment (here by means of screws 16 placed at each end of the insert). The indentations will then be made in a single simultaneous machining operation of the body of the sabot 2 and the inserts 11. The perfect continuity of the indentations is thus ensured between the different materials, thereby facilitating the assembly of the penetrator 3.

The front and rear ends of each insert incorporate tabs 28 housed in matching depressions made in the sabot body. These tabs carry the female threading receiving the fastening screw 16 and ensure the radial retention of the insert with respect to the sabot.

The hybrid sabot according to the invention is thus formed of the assembling of an aluminum body (light material but with low mechanical properties) with inserts of a generally denser material (titanium or steel) but with high mechanical properties.

The materials are distributed in the sabot in correlation with the mechanical stresses to which they are to be subjected.

The most mechanically stressed zones of the sabot are the front 9 and rear 8 median zones since they must withstand substantial longitudinal and transversal inertial loads generated by the penetrator 3. The thickness of these zones in reduced and the insert material predominates in these zones.

The thrust plate 7 is less mechanically stressed. It is thus unnecessary to implement a material that has high mechanical strength at the thrust plate. The material must, however, be light since the sabot is voluminous at this point.

The material of the sabot body will thus be predominant at the thrust plate.

As may be more particularly seen in the sections (FIGS. 3*b* and 3*c*) the insert is thus thinner at the thrust plate 7 (FIG. 3*c*) than on either side of it (FIG. 3*b*). Such an arrangement also allows the aluminum surface (sabot body), which is in contact with the penetrator at the thrust plate 7, to be increased. Resistance to shearing of the sabot body 2 in the zone of the sabot where the shearing stresses are the strongest is thus improved.

Furthermore, at the thrust plate 7, the sabot body 2 comprises two bearing surfaces 17 and 18 for the insert. These surfaces are positioned on either side of the thrust plate 7. The front 18 and rear 17 bearing surfaces ensure that the front and rear parts of the insert 11, to which the inertial loads of the penetrator are applied, are driven by the sabot body 2.

Bearing surfaces 17 and 18 are plane and inclined with respect to the sabot axis 19.

The insert 11 is of a length selected such that it only covers the most mechanically stressed front and rear parts. It is thus pointless to prolong the insert to the front and rear ends of the sabot, which are less mechanically stressed than the median parts of these front 9 and rear 8 parts.

Thus, as may be seen in FIG. 2*b*, the rear length $L_R$ of the insert 11 between the rear bearing surface 17 and its rear end is between 50% and 70% of the length $L_1$ of all the rear part 8 of the sabot (length between the rear bearing surface 17 and the rear end of the sabot).

Similarly, the front length $L_F$ of the insert 11 between the bearing surface 18 and its front end is between 40% and 70% of the length $L_2$ of the front part 9 of the sabot (length between the front bearing surface 18 and the front end of the sabot).

The sabot according to the invention thus has a mass of 20 to 30% less than homogenous sabots made of aluminum, whilst having adequate mechanical strength.

This results in an increase in the velocity of the penetrator of around 5% to 8%, thus an increase in its performances.

A second embodiment is shown in FIGS. 4*a*, 4*b*, 4*c*, 5*a* and 5*b*.

For the sake of clarity, the sabot is shown on the Figures alone, without the penetrator, the band and the retention rings.

This embodiment differs from the previous one in that the inserts 11 are placed at the joint faces 20*a*, 20*b* and 20*c* that separate the different segments 2*a*, 2*b* and 2*c*.

Furthermore, and classically, this sabot incorporates a calibred conical part 21 at its front part and in place of the arms 10.

This conical part incorporates a front pocket 22 intended to receive the external aerodynamic drag upon exiting the gun barrel so as to facilitate the opening of the sabot.

So as to receive the inserts, the body of each segment 2*a*, 2*b* and 2*c* incorporates two longitudinal recesses 23 each made in a joint face (20*a*, 20*b* or 20*c*). These recesses 23 can be more particularly seen in FIGS. 5*a* and 5*b*.

The recesses 23 extend on either side of the thrust plate 7.

Once again, the sabot body 2 comprises at least two bearing surfaces 17 and 18 at the thrust plate 7 for the insert 11. These bearing surfaces are arranged on either side on the thrust plate 7.

Each insert 11 is made integral with a single sabot segment by a screw 24 placed level with the thrust plate 7 of the segment in question.

Figure 4C:
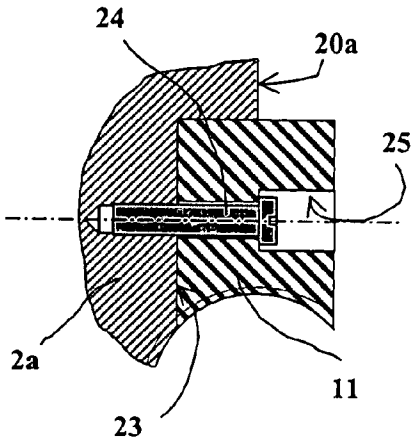
FIG. 4*c* is a detailed view of the link being the insert and a sabot segment.
Figure 4A:
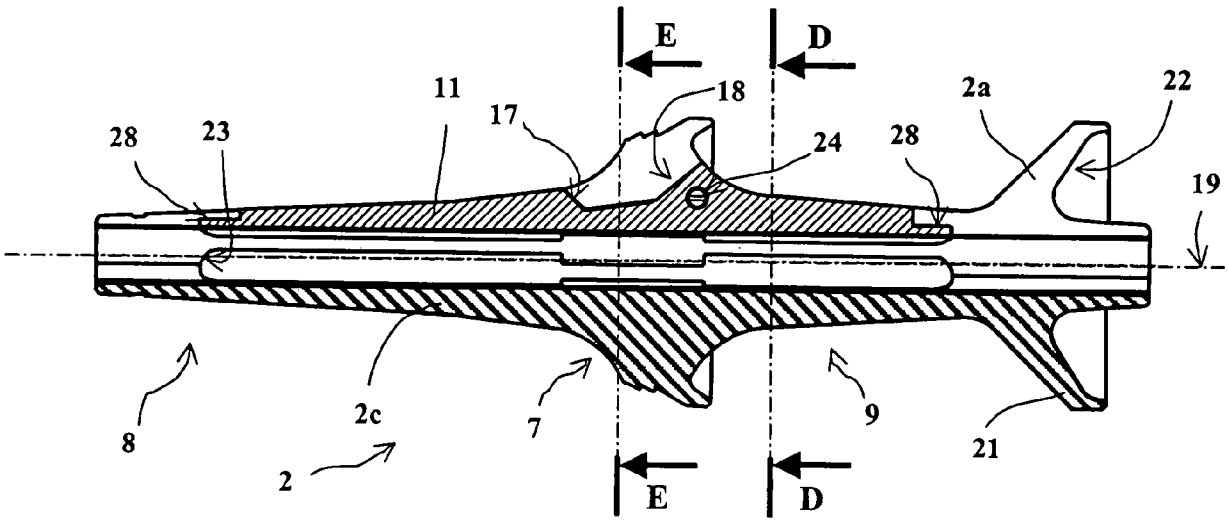
Figure 4B:
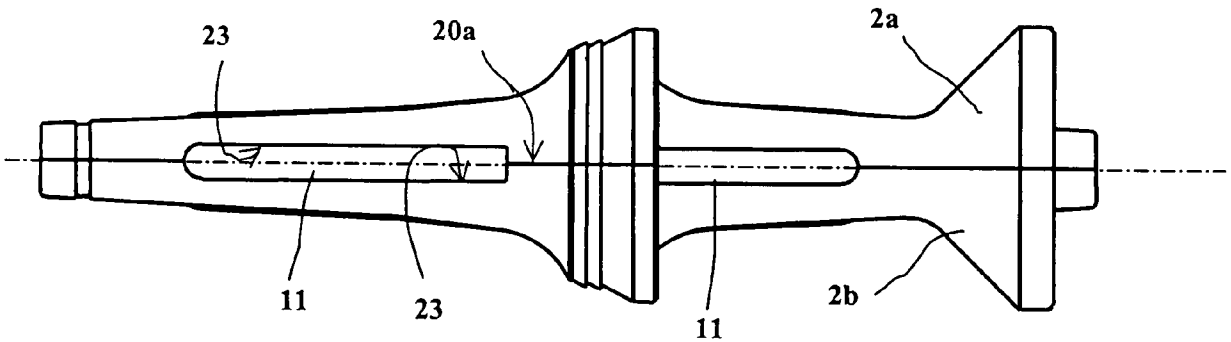
Figure 5A:
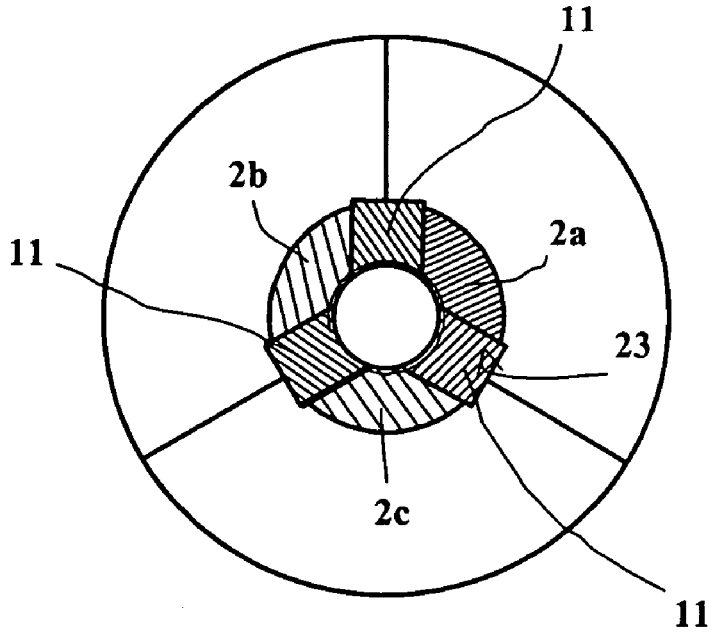
FIGS. 5*a* and 5*b* are cross sections of this sabot, sections made along the planes reference respectively DD and EE in FIG. 4*a*.
Figure 5B:
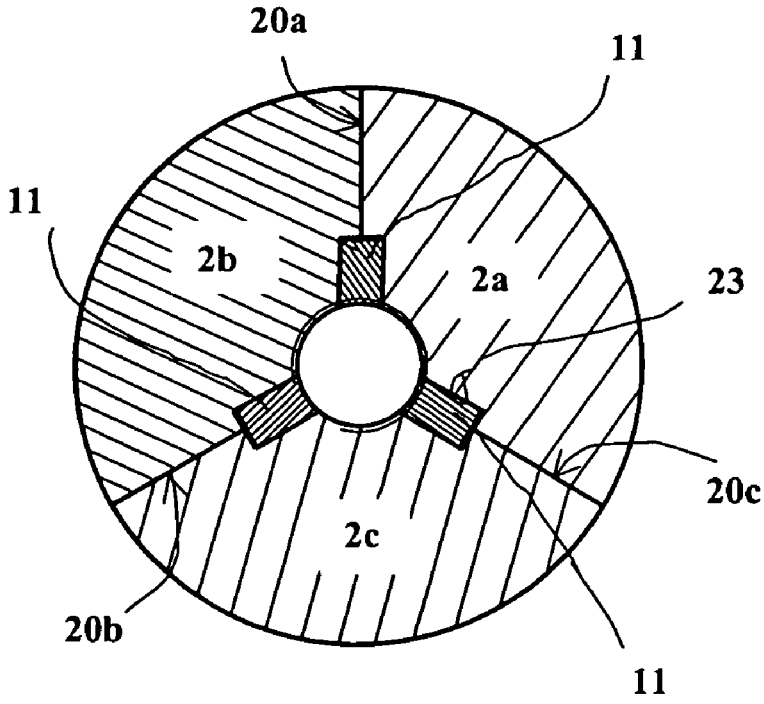

This screw is housed in a counter-sink 25 in the insert 11 such that does not hinder the assembly of the segments (see FIG. 4*c*).

The shaft of the screw 24 is perpendicular to the joint face 20 in question, in which a threaded bore is made to receive the screw.

Once again, the front and rear ends of each insert incorporate tabs 28 housed in matching depressions in the sabot body. These tabs ensure the radial retention of the insert with respect to the sabot.

Figure 6A:
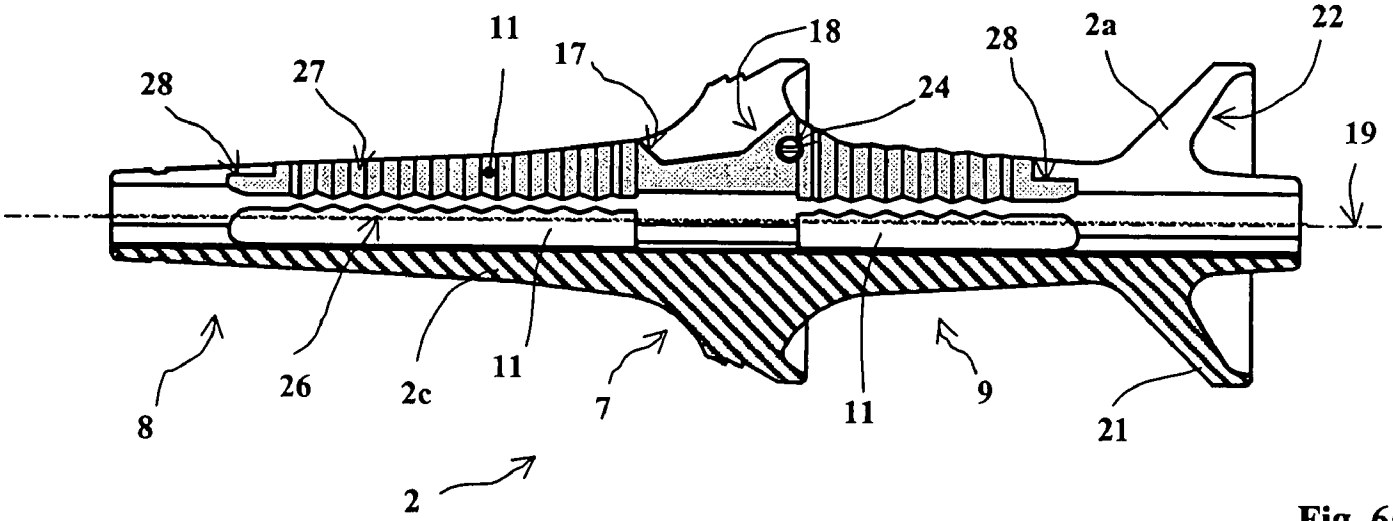
FIGS. 6*a* and 6*b* show a variant of the sabot according to this second embodiment, view 6*a* being a longitudinal section and view 6*b* being a non-sectioned view.
Figure 6B:
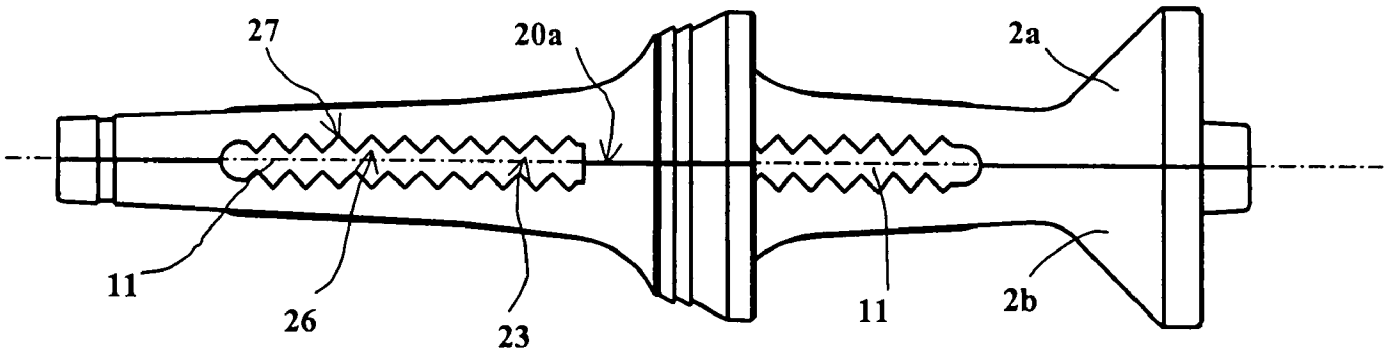

FIGS. 6*a* and 6*b* show a variant of this second embodiment.

FIG. 6*a* shows two inserts 11 that are not sectioned.

In accordance with this variant, each recess 23 has a profile 26, formed here by a succession of teeth oriented perpendicularly to the sabot axis 19. This toothed profile 26 cooperates with a matching profile 27 on the insert 11.

Such an arrangement allows the loads between the sabot body 2 and the insert 11 to be distributed over a larger surface. It also prevents any relative axial movement of the inserts with respect to the sabot segments during firing.

Once again, the inserts 11 extend on either side of the thrust plate 7 and the body 2 comprises two bearing surface 17 and 18 at the thrust plate 7 for the insert. Each insert is fastened to a sabot segment by a screw 24. The front and rear ends of the inserts incorporate tabs 28 that are housed in matching depressions in the sabot body and that ensure the radial retention of the insert with respect to the sabot.

Figure 7A:
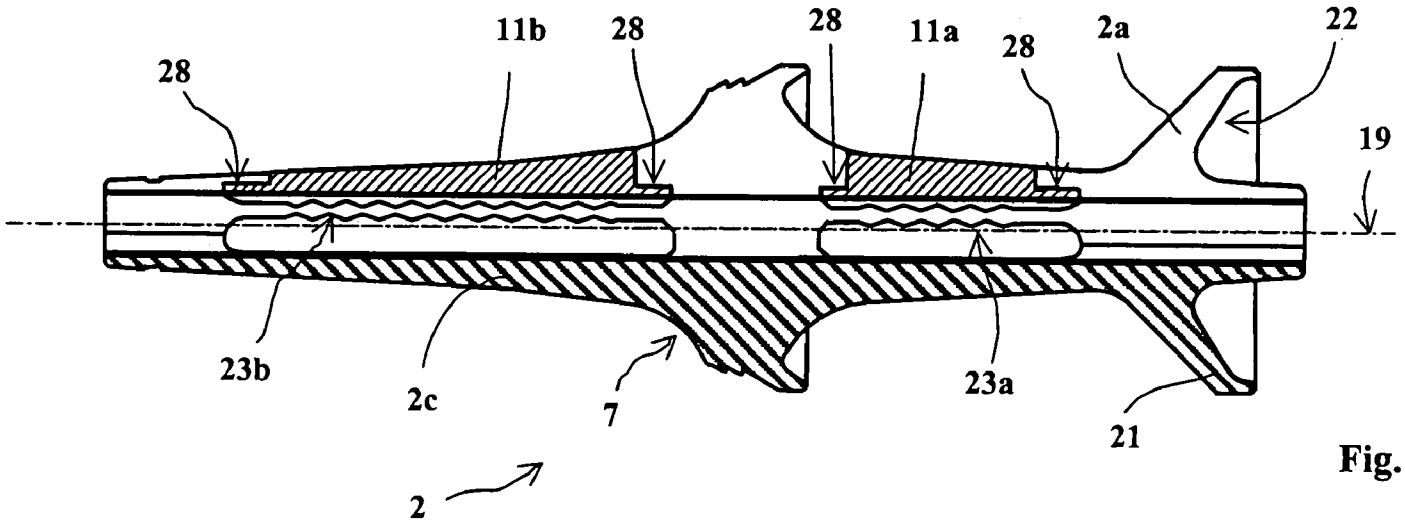
FIGS. 7*a* and 7*b* show a variant of the sabot according to this second embodiment, view 7*a* being a longitudinal section and view 7*b* being a non-sectioned view.
Figure 7B:
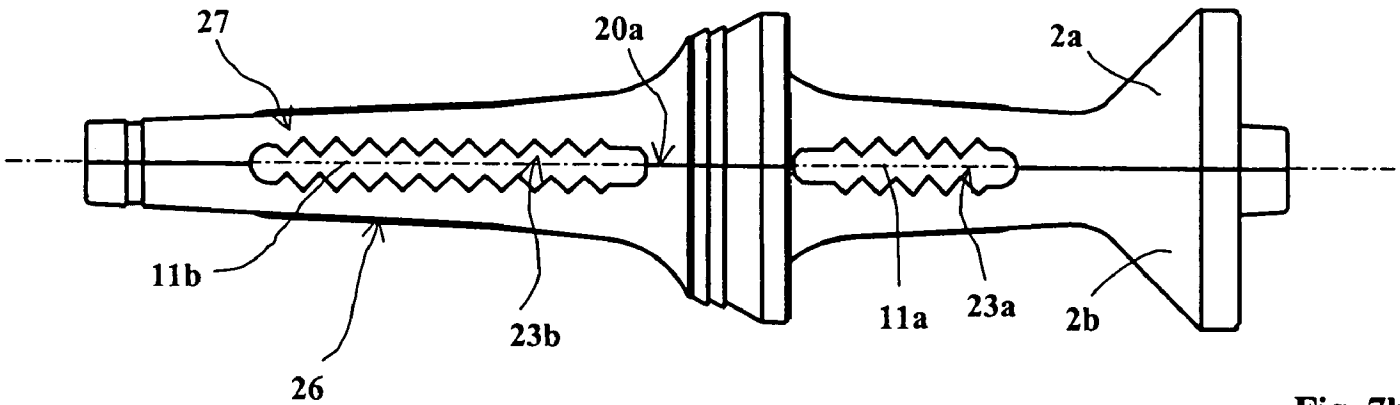

FIGS. 7*a* and 7*b* show another variant of this embodiment.

This variant differs from the previous one in that each joint face 20*a*, 20*b* and 20*c* has two recesses 23*a* and 23*b*. Recess 23*a* is arranged to the fore of the thrust plate 7 and recess 23*b* is arranged to the rear of the thrust plate.

Each recess 23*a* or 23*b* receives a specific insert 11*a* or 11*b*.

Once again, each recess has a profile 26 that cooperates with a matching profile 27 on the insert.

The profiles are formed by a succession of teeth oriented perpendicularly to the sabot axis 19.

These profiles ensure the transmission of the inertial load of the penetrator between the insert and the sabot body.

The front and rear ends of each insert incorporate tabs 28 housed in matching depressions in the sabot body and that ensure the radial retention of the insert with respect to the sabot.

In this variant, there is no insert at the thrust plate, the sabot's mass is thus reduced.

Each insert is fastened to a sabot segment, for example by bonding.

What is claimed is:

1. A sabot for a projectile comprising at least two segments intended to surround and drive a sub-calibre penetrator, such sabot comprising a calibred thrust plate, wherein said sabot incorporates a body made of a light material longitudinally extending and having indentations therein, said body having at least one longitudinal insert made of a material having a longitudinal modulus of elasticity that is greater than or equal to 100 Giga Pascals and an elastic limit greater than or equal to 900 Mega Pascals, said insert having indentations cooperating with an external profile of said penetrator to allow it to be driven, said indentations longitudinally aligned with and extending those of the body of said sabot and which thus also cooperate with the external profile of said penetrator.

2. A sabot according to claim 1, wherein said material of said insert is selected from among the following materials: titanium or titanium alloy, steel, composite material.

3. A sabot according to claim 1, wherein said insert is thinner at the vicinity of said thrust plate than on either side of it.

4. A sabot according to claim 3, wherein said insert extends longitudinally on either side of said thrust plate, said body comprising at least two bearing surfaces level with said thrust plate for said insert, said surfaces arranged on either side of said thrust plate.

5. A sabot according to claim 4, wherein said body of said each segment incorporates a longitudinal recess in its plane of symmetry for receiving said insert.

6. A sabot according to claim 5, wherein said recess passes radially through the body of said segment on either side of said thrust plate.

7. A sabot according to claim 4, wherein said insert is made integral with said segment body by at least two screws arranged near to the front and rear ends of said insert.

8. A sabot according to claim 1, wherein said body of said each segment incorporates at least two longitudinal recesses, each recess being made at a joint face intended to come into contact with another segment when said sabot is assembled, said inserts being thus positioned at the inter-segment joint faces of said sabot.

9. A sabot according to claim 8, wherein said each recess incorporates a profile that cooperates with a matching profile carried by said insert.

10. A sabot according to claim 9, wherein said each joint face is provided with two recesses, one recess being placed to the fore of said thrust plate and the other recess to its rear, said each recess being intended to receive a specific insert.

11. A sabot according to claim 8, wherein said recesses arranged in said body of said each segment extend on either side of said thrust plate, said body comprising at least two bearing surfaces for said insert at said thrust plate, such said surfaces being arranged on either side of said thrust plate.

12. A sabot according to claim 11, wherein said each insert is made integral with one said segment body by at least one screw arranged at said thrust plate part of said segment in question.

* * * * *